US005847509A

United States Patent [19]

Wuest

[11] Patent Number: 5,847,509

[45] Date of Patent: Dec. 8, 1998

[54] MICROGAP FLAT PANEL DISPLAY

[75] Inventor: Craig R. Wuest, Danville, Calif.

[73] Assignee: The Regents of the University of California, Oakland, Calif.

[21] Appl. No.: 678,582

[22] Filed: Jul. 8, 1996

[51] Int. Cl.[6] ..... H01J 17/49

[52] U.S. Cl. ..... 313/582; 313/584; 313/585; 345/67

[58] Field of Search ..... 313/582, 584, 313/585, 586, 587; 345/37, 60, 67

[56] References Cited

U.S. PATENT DOCUMENTS

| | | | |
|---|---|---|---|
| 3,787,106 | 1/1974 | Schermerhorn | 313/584 X |
| 3,848,248 | 11/1974 | MacIntyre, Jr. | 313/584 X |
| 4,126,807 | 11/1978 | Wedding et al. | 313/586 |
| 4,794,308 | 12/1988 | Ernsthausen | 313/586 X |
| 5,294,789 | 3/1994 | Kruger | 250/214.1 |
| 5,308,987 | 5/1994 | Wuest et al. | 250/374 |
| 5,349,194 | 9/1994 | Wuest et al. | 250/372 |
| 5,525,862 | 6/1996 | Miyazaki | 313/582 |

*Primary Examiner*—Ashok Patel
*Attorney, Agent, or Firm*—L. E. Carnahan

[57] ABSTRACT

A microgap flat panel display which includes a thin gas-filled display tube that utilizes switched X-Y "pixel" strips to trigger electron avalanches and activate a phosphor at a given location on a display screen. The panel utilizes the principal of electron multiplication in a gas subjected to a high electric field to provide sufficient electron current to activate standard luminescent phosphors located on an anode. The X-Y conductive strips of a few micron widths may for example, be deposited on opposite sides of a thin insulating substrate, or on one side of the adjacent substrates and function as a cathode. The X-Y strips are separated from the anode by a gap filled with a suitable gas. Electrical bias is selectively switched onto X and Y strips to activate a "pixel" in the region where these strips overlap. A small amount of a long-lived radioisotope is used to initiate an electron avalanche in the overlap region when bias is applied. The avalanche travels through the gas filled gap and activates a luminescent phosphor of a selected color. The bias is adjusted to give a proportional electron multiplication to control brightness for given pixel.

19 Claims, 3 Drawing Sheets

MICROGAP FLAT PANEL DISPLAY

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention is directed to flat panel displays, particularly to flat panel displays which can trigger monochrome or additive color pixels, and more particularly to a flat panel display which utilizes a coplanar anode. and cathode separated by a gas-filled gap and which includes crossed X-Y strips such that when a proper electrical bias is applied initiate electron avalanches across the gas-filled gap to activate luminescent phosphors.

There are various types of devices which utilize photons. Some of these devices convert photons into electronic signals, and other devices convert electrical pulses into photons.

The devices which can be processed into pulses or images are generally considered as photon detectors. These devices include photodiodes, photomultiplier tubes, vidicons, charged-coupled devices (CCDs), and silicon detectors doped with impurities such as lithium or gallium.

Recently, microgap photon detectors have been developed which convert photons into electrons (photoelectrons) with subsequent amplification of these photoelectrons through the generation of electron avalanches in a then gas-filled region (microgap) subjected to high electric potential. The microgap detector exhibits the fast time response typical of photomultiplier tubes, with pulse widths less than 10 nanoseconds (ns) and as fast as 1 ns, thus allowing it to operate with frequency response up to the GigaHertz level. The microgap detector provides adjustable gain of up to about $10^8$ depending on the choice of fill gas and electric potential, and exhibits low noise, typical of photomultiplier tubes. The microgap detectors are exemplified by U.S. Pat. Nos. 5,308,987 issued May 3, 1994 to C. R. Wuest et al.; No. 5,294,789 issued Mar. 15, 1994 to H. W. Kruger; and No. 5,349,194 issued Sep. 20, 1994 to C. R. Wuest et al., each assigned to the same assignee.

The devices which convert electrical pulses into photons are exemplified by the cathode ray tubes (CRTs) which utilize phosphors, for example, to convert electron avalanches or beams into visible photons for television and computer displays.

Currently there is a great interest in flat panel displays for both civilian and defense applications. Such displays involve the conversion of electrons into photons. A number of programs exist to develop large, reliable, low-power, thin displays for avionics, battlefield systems, computer and video displays. Applications also include ruggedized, radiation hardened displays for use in hostile environments, including high magnetic fields. Efforts are also going forward to develop flat panel displays for personal computers, television, video conferencing and video telephony, games, medical imaging, projection television systems and large format displays, where standard CRTs become limited by weight, power requirements, and aspect ratio.

The prior known flat panel displays are primarily plasma and liquid crystal displays. Also, standard or high-efficiency phosphors have been previously utilized in flat panel displays to convert electrons into visible photons as in current CRTs for television and computer displays. The prior flat panel displays have been required to operate in a flat plane, and thus could not be effectively utilized for curved or spherical displays. In addition, the prior flat panel displays are affected by magnetic fields and thus required protective shielding therefrom.

The present invention a microgap flat panel display, while utilizing phosphors to convert electrons incident thereon into visible photons, utilizes a co-planar anode and cathode arrangement separated by a gas-filled gap, wherein an electron avalanche initiated by the cathode is converted by selected phosphors attached to the anode into visible photons, as in current CRT. The invention is basically a microgap detector operating in reverse. However, the co-planar anode and cathode arrangement of the microgap display of this invention need not be in a flat plane but as long as the anode and cathode planes are co-planar the display will function, thus enabling the fabrication of curved and spherical displays. Also, because the flat panel display of this invention is thin and the electron pulse is fast, it is not susceptible to the distortion of the picture by magnetic fields, thus no magnetic shielding is needed. In addition, it can operate in harsh environments such as high radiation and high temperature environments. Also, the display of this invention is of low mass and consumes little power in normal operation, thus making battery operation possible, as well as enabling use in applications, such as avionics, where weight and power consumption are primary considerations.

SUMMARY OF THE INVENTION

It is an object of the present invention to provide a microgap flat panel display.

A further object of the invention is to provide a flat panel display which is of low mass and has low power consumption.

A further object of the invention is to provide a panel display which utilizes a co-planar anode and cathode arrangement which enable fabrication of spherical or curved displays.

A further object of the invention is to provide a microgap panel display which is not affected by magnetic fields.

A further object of the invention is to provide a flat panel display which can operate in harsh environments.

Another object of the invention is to provide a microgap flat panel display wherein the anode and cathode are separated by a gas-filled gap or region.

Another object of the invention is to provide a microgap flat panel display wherein the anode includes luminescent phosphors and the cathode includes a small amount of a long-lived radioisotope and an array of x and y conductive strips, whereby an electrical bias on an overlapping region of the X and Y strips cause the initiation of an electron avalanche which is detected by a luminescent phosphor.

Another object of the invention is to provide a microgap flat panel display which utilizes X and Y conductive strips, which are energized by the application of a negative bias at a point of overlap of the strips to create an electric field sufficient to cause gas amplifications of a seed electron in a gas-filled gap between the cathode and anode, the bias being controlled by an electronic switching system.

Other objects and advantages of the present invention will become apparent from the following description and accompanying drawings. The microgap flat panel display of this invention is in a sense a microgap photon detector operating in reverse. Instead of converting photons into electrical pulses, the display converts electrical pulses into photons. A small amount of radioactive material, such as americium-241 (commonly used in home smoke detectors) is used to initiate ionization in the gas-filled gap with sufficient frequency that an electron avalanche can be triggered by the application sufficient electrical bias on crossed or overlapped X-Y conductive strips at a time which is correct for video display purposes. Standard or high-efficiency phosphors are used to convert the electron avalanche incident on it into visible photons, as in current CRTs for television and computer displays. Phosphor-based displays offer advantages over standard plasma and liquid crystal displays in terms of color quality, angular emissivity, and brightness. The microgap flat panel display can be fabricated using standard photolithographic techniques and phosphor deposition techniques. Additionally, the "flatness" of the display really is "co-planarity" —as long as the anode and cathode planes are co-planar the display will function correctly. This allows the fabrication of curved displays or spherical displays coupled to wide-field-of-view optics for high efficiency projective systems without aberration. In addition, the extreme speed of the electron avalanche allows video rates that are much greater than standard video. The small size of the electron avalanche and the proximity focusing eliminates complicated electron optics, raster systems, filters and guns, and allows pixel densities much greater than currently available.

Because the microgap flat panel display is thin and the electron pulse is fast, it is not susceptible to the distortion of the picture by magnetic fields. In addition, it can operate in harsh environments such as high radiation and high temperature environments.

The microgap flat panel display is low mass and consumes little power in normal operation. It requires relatively low voltages compared to CRT displays, typically a few hundred volts to one thousand volts. However, the power required to operate the display is low compared to both CRT and liquid crystal displays, making battery operation possible. These properties also make the microgap display desirable for avionics and other systems where weight and power consumption are at a premium.

The microgap flat panel display utilizes a plurality of X-Y conductive strips. A single X and Y overlap or crossover regions is energized by the application of a negative bias to create an electric field sufficient to cause gas amplification of a seed electron to excite a phosphor. The electron is generated by the presence of a thin layer of Am-241, an alpha emitter, or by atomically sharp field-emission tips. The bias is set such that no avalanche occurs for -HV/2, but avalanches occur for the summed application of -HV. The field is restricted to a narrow region of space corresponding to the pixel (phosphor) to be illuminated and the avalanche is proximity-focused to that particular pixel. By way of example, the microgap flat panel display may include 640×480 pixels at 60 Hz screen refresh rate.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

Figure 2:
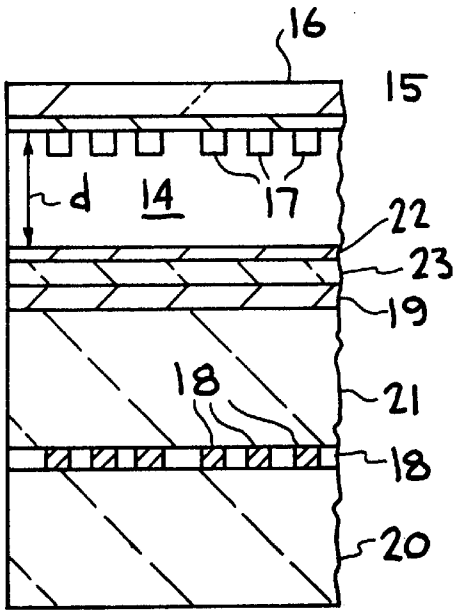
FIG. 2 is a partial, cross-sectional end view of the FIG. 1 embodiment.

The present invention involves a microgap flat panel display which includes a thin gas-filled gap that utilizes switched X-Y "pixel" strips to trigger electron avalanches and activate a phosphor at a given location on a display screen. The panel is simpler and lower power than existing plasma displays and offers the potential of much higher image quality and pixel density at low cost. The panel utilizes the principle of electron multiplication in a gas subjected to a high electric field to provide sufficient electron current to activate standard luminescent phosphors. X-Y conductive strips of a few micron width are deposited on either side of a thin insulating substrate or on the side of adjacent substrates, and together with a quantity of a long-lived radioisotope, such as americium-241, or atomically sharp field-emission tips, form a cathode. The cathode is separated from an anode containing the luminescent phosphors by a few hundred micron gap filled with a suitable gas, such as argon, with a small amount of isobutane. Electrical bias is switched onto X and Y strips to activate a "pixel" in the region where these strips overlap or cross. The small amount of americium-241 (Am-241), which is commonly used in home smoke detectors, is used to initiate an electron avalanche in the overlap region when electrical bias is applied. Alternatively, field emitters consisting of atomically sharp points of silicon or other suitable material can seed the avalanche when bias is supplied in the vicinity of the emitter. The bias is adjusted to give a proportional electron multiplication to control brightness for a given pixel. With proper layout of the X-Y strips, monochrome or additive color pixels can be triggered to form a display conforming to any video standard, e.g., NTSC, PAL, or SECAM. In addition, non-standard and high speed video applications can be accommodated by virtue of the extreme speed of the electron avalanche, typically a few nanoseconds in duration. The display function does not require flatness for proper operation. Any coplanar surfaces with the proper gas gap can function correctly and this gives rise to applications such as spherical displays coupled to wide area spherical optics for projection systems. Additionally, this display is not affected by magnetic fields and does not require protective shielding for magnetic fields.

In its simplest form, the microgap flat panel display of this invention consists of a coplanar anode and cathode separated by a thin gas-filled gap or region with a dimension, D. An electric potential, V, is applied in the region between the anode and cathode, defined by crossed x-y conductive strips, as shown in FIGS. 1–4, with the strips placed on opposite sides of an insulating plane to provide an electric field, E, that is equal to the electric potential divided by the gap dimension, E=V/D. The gap dimension and electric potential are chosen in order to provide an electric field of the order of $10^6$ volts per meter. Thus, a total gap of 1000 microns ($10^{-3}$m) and an electric potential of 1000 volts gives an electric field, E=1000 volts/$10^{-3}$m=$10^6$ volts/meter.

Figure 5:
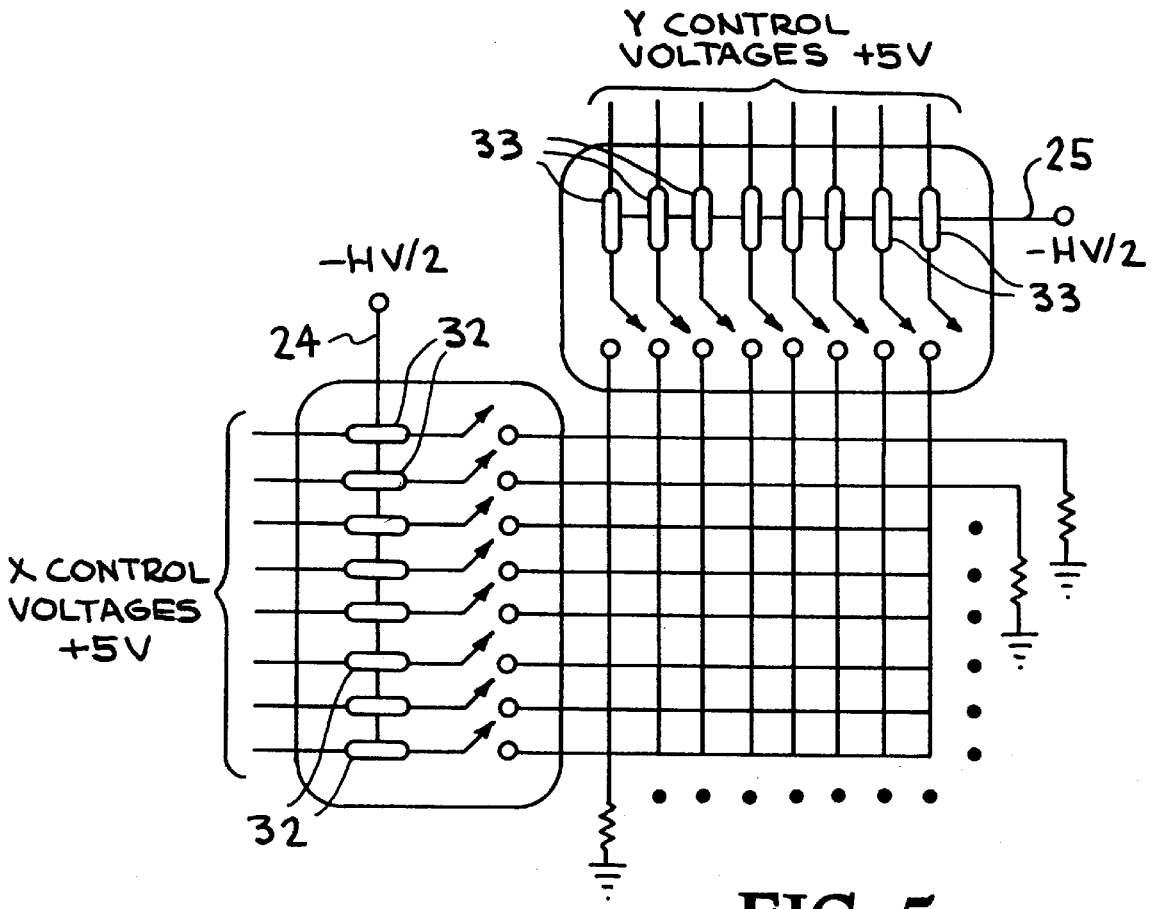
FIG. 5 is a schematic illustration of an electronic switching system for changing the bias on the x-y conductive strips of the embodiments of FIGS. 1 and 3.
Figure 6:
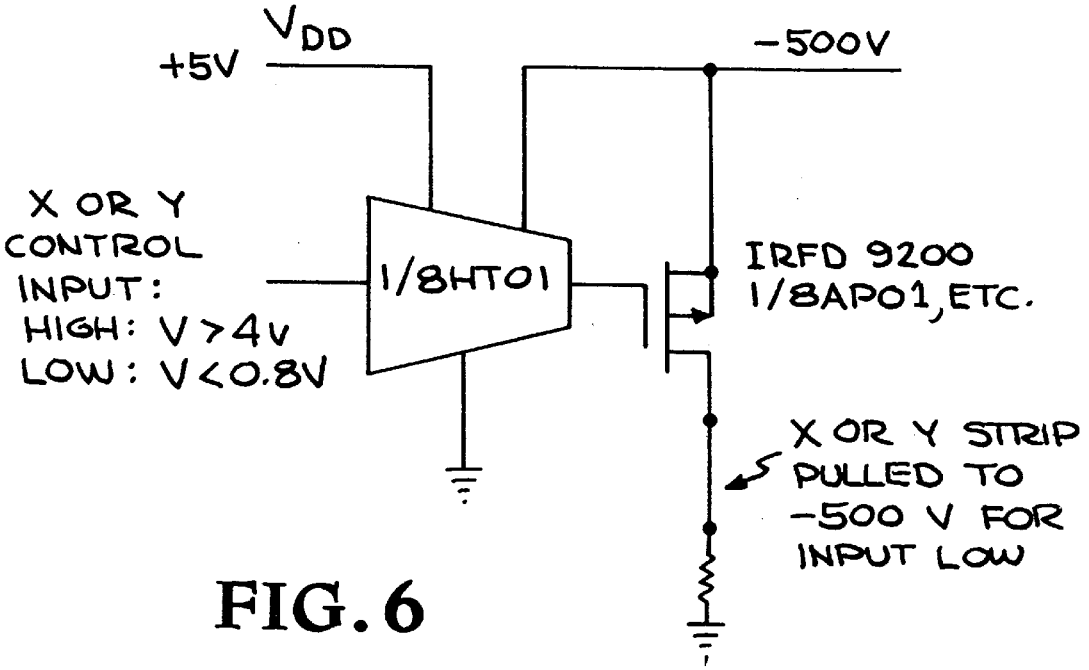
FIG. 6 schematically illustrates a single logic-level driven HV switch of the FIG. 5 system.

Referring now to the drawings, FIGS. 1–2 and FIGS. 3–4 illustrate embodiments of the microgap flat panel display, while FIGS. 5 and 6 schematically illustrates a standard electronic switching system for application of electrical bias to the X-Y network of strips. The embodiments of FIGS. 1–2 and FIGS. 3–4 differ in the means to generate or initiate the electron avalanche. In the FIGS. 1–2 embodiment a quantity of Am-241, an alpha emitter is used, while in the FIG. 3–4 embodiment a quantity of atomically sharp field-emission tips, constructed of silicon for example, are used.

Figure 1:
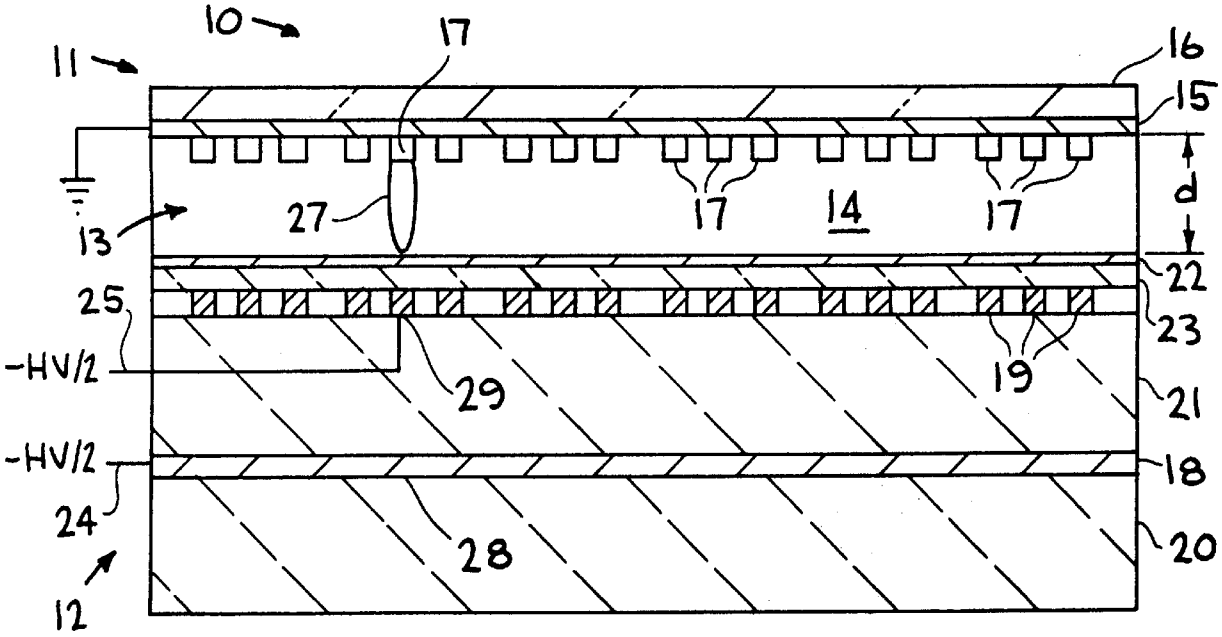
FIG. 1 is a cross-sectional view of an embodiment of the microgap flat panel display made in accordance with the present invention.
Figure 4:
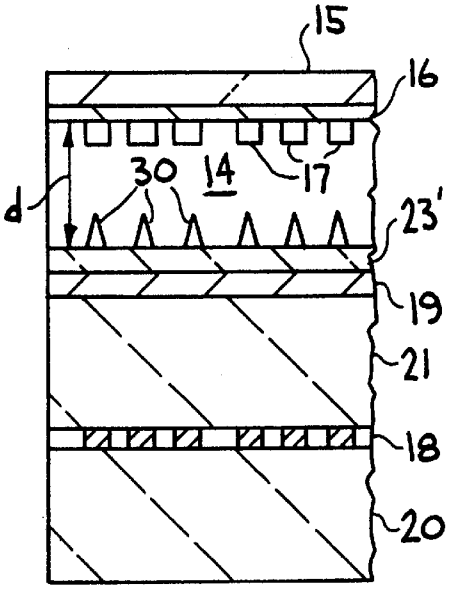
FIG. 4 is a partial, cross-sectional end view of the embodiment of FIG. 3.
Figure 3:
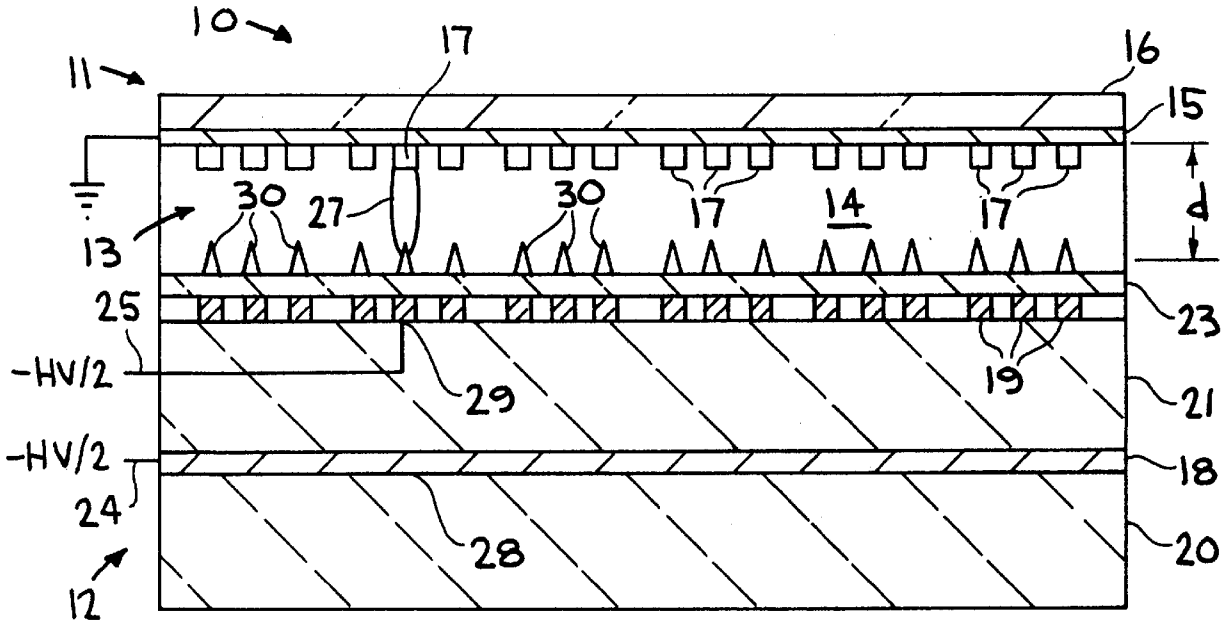
FIG. 3 is a cross-sectional view of another embodiment of the invention.

Referring now to the embodiment of FIGS. 1–2, the microgap flat panel display, generally indicated at 10 consists basically of an anode, generally indicated at 11 and a cathode, generally indicated at 12, separated by a gap or region indicated at 13 having a distance thereacross indicated at D, and filled with a gas indicated at 14, such as argon with a small amount of isobutane or methane, for example, 5% of isobutane is contained in 95% of argon at a pressure of 1.0 bar in a gap or region 13 having a height or distance of 100 microns between the anode and cathode, a width of ~6" and length of ~8", for operating 640×480 pixels with a pitch of ~0.1", when a potential, such as 500 volts, is applied across gas 14 in the gap 13. The distance D of gap 13 may range from 0.004" to 0.008", and the gas 14 may be composed of Ar, $CH_4$, or $C_4H_{10}$ (isobutane) or a mixture thereof, with a pressure of 0.5 bar to 1.0 bar depending on the application.

The anode 11 is composed of a thin conductive layer 15, such as gold, deposited on a transparent insulator 16, with phosphor dots 17 deposited on the conductive layer 15. By way of example, the layer 15, in addition to gold, may be composed of Al, Cr, Ni, or Cu, having a thickness of 500Å to 1000Å. The transparent insulator 16 may be composed of glass, quartz, or plastic with a thickness of 1 mm to 5 mm. The phosphor dots 17 may consist of a monochrome array or of a standard three color additive array, as shown, with the colors being red, green, and blue, extending from left to right as illustrated by a series of three dot sets in FIG. 1, for example. By way of example, the phosphor dots 17 may have a 70 micron diameter and a 200 micron pitch or distance between phosphor triads, in the case of a color display. For a display 10 of 640×480 pixels, there would be a monochrome phosphor dot or three color phosphor triad for each pixel.

The cathode 12 is composed of a plurality of X and Y oriented conductive strips 18 and 19 deposited on insulating substrates 20 and 21. However, the strips 18 and 19 can be deposited on opposite sides of insulating substrate 20, with substrate 21 serving to insulate the X strip 18 and support the cathode. A thin layer 22 of a long-lived radioisotope, such as americium-241, is deposited on or impregnated into a thin substrate 23 composed of glass, quartz, mylar, or plastic, which is located on top of the Y strips 19. The radioisotope may also be composed of Th-228 or Cm-244. The layer 22 of americium-241 has a thickness of 1Å to 2Å, with substrate 23 having a thickness of 0.005" to 0.002". Where the radioisotope is impregnated into the substrate 23, about $10^{17}$–$10^{20}$ atoms/cm$^2$ is used in a substrate of mylar having a thickness of 0.0005" for example. By way of example the conductive strips 18 and 19 may be composed of Au, Cu, Al, or Cr, with a preferred width of 20 microns and height of 5 microns, but the width may range from 20 to 50 microns, with the height ranging from 5 to 25. Note that the X-Y strips 18 and 19 are shown in sets of three to correspond to the three dot sets of phosphors 17.

The radioisotope (i.e. Am-241) emits alpha particles into the gas-filled region 13 at some areal rate R/mm$^2$. R is chosen such that the probability of an ionization occurring during a pixel cycle is 1. Radioactive initiators such as this are commonly used in home smoke detectors and the amount is small and does not pose a health risk under normal circumstances. Typical video displays would require between 1–20 milli Ci of initiator, while the amount used in the flat panel display of FIGS. 1–2 is between 1–10 mCi Am-241.

An electric potential, such as 500 volts for example, is applied across the gap 13, as shown in FIG. 1 by the legends -HV/2 of cathode 12 indicated at 24 and 25 for applying an electrical bias to the X and Y strips of the cathode 12, and the ground symbol indicated at 26 connected to the layer 15 of the anode 11. FIG. 5, described in greater detail hereinafter, illustrates the power source and electronic switching system for the panel 10. An electric bias is used to initiate the formation of an electron avalanche indicated at 27 for exciting a phosphor dot 17, as shown in FIG. 1. The bias is set such that no electron avalanche occurs for -HV/2, but avalanches can occur for the summed application of -HV, that is when the bias is directed to an overlap or cross point of a conductive strip 18 and a conductive strip 19. Thus, a single point on each of the X and Y strips, indicated at 28 and 29, are energized by the application of a negative bias to create an electric field sufficient to cause a gas amplification of a seed electron. The electron is generated by the presence of the thin layer 22 of Am-241, an alpha emitter. The field is restricted to a narrow region of space corresponding to the pixel (phosphor dot 17) to be illuminated and the avalanche 27 is proximity-focused to that particular pixel. The operating voltage, typically a few hundred volts (500 in FIG. 1) to one thousand volts, is low compared to a CTR.

It is thus seen that when ionization occurs in a pixel region that does not have a bias voltage applied, no amplification of the electrons will occur. Applications of a bias is required to amplify the ionization sufficiently to create enough electrons to create an electron avalanche 27 and energize a phosphor pixel 17. Electrons under conditions of bias in the gas-filled gap are accelerated in the extremely high electric field toward the anode (the phosphor plane). The accelerating electron collides with other electrons in the gas atoms to create additional electrons, and so on, until an electron avalanche 27 is formed. An electron avalanche can be thought of as a sort of electron chain reaction. Under the proper choices of gas type, and pressure, and electric field, gains of $10^8$ or more can be achieved by the time the avalanche reaches the anode. The avalanche 27 is detected on the anode by the tell-tale luminescence of the phosphor 17.

Typically, in proportional mode the electron avalanche spreads about 0.1 radian as it progresses towards the anode. For a 100 micron gap the electron is "proximity focused" with a spot size of 10 microns. Brightness can be controlled by varying the bias on the X-Y strips to allow fewer or greater electrons in the avalanche corresponding to dimmer or brighter luminescence of the phosphor.

By way of example, the FIGS. 1–2 embodiment of the microgap flat panel display has typical values of: 100 micron gas gap, 500 volts for HV/2, 20 micron X and Y strip width, 70 micron phosphor dot diameter, 200 micron phosphor pitch or height, and 1–10 mCi Am-241 (for 640×480 pixels at 60 Hz). The embodiment of FIGS. 3–4 differs from that of FIGS. 1–2 in the means for initiating the electron avalanche. Corresponding components are given corresponding reference numerals. In place of the layer 22 of radioactive material or imbedding of the radioactive material in the substrate 23, as in the FIGS. 1–2 embodiment, in the FIG. 3–4 embodiment the substrate 23' is provided with sets of atomically sharp points 30 arrayed to correspond to the three pixel (phosphor dot) sets and used as field emitters that liberate electrons when a field of sufficient amplitude is applied. The points 30 may be composed of silicon, GaAs, $SiO_2$, or $Si_3N_4$, have a height or 1 to 2 microns and a cross-section or diameter at the base thereof of 1 to 2 microns. The points 30 may utilize a base configuration which is circular, triangular, square, or other configuration. The application of bias voltage to the X-Y network of conductive strips can be carried out using standard electronic switching systems consisting of transistor arrays. FIG. 5 partially illustrates such a switching system. Coding schemes for imaging are completely arbitrary and can accommodate standard video switching speeds encountered in NTSC, PAL, SECAM, CCIR and other video standards used for television, as well as computer graphics RGB interlaced and non-interlaced pixel displays. In addition, the speed of the display allows for the application of much higher video rates and denser pixels for improved resolution and image quality.

Referring now to FIGS. 5 and 6, the bias voltage -HV/2 applied to the single points (28 and 29 of FIG. 1) on the X and Y conductive strips 18 and 19 is applied via the logic-level driven HV switch network of FIG. 5, with FIG. 6 illustrating in detail a single logic-level driven HV switch of the FIG. 5 network. The example of the standard switch network illustrated in FIG. 5 is for an 8×8 strip (64 pixel) control circuit using MOSFET logic-level driven HV switch network. See Horowitz and Hill, "The Art of Electronics". Logic levels generated by video control electronics are energized at +5V at the appropriate X and Y locations to switch -HV/2 (see 25 and 26 of FIGS. 1 and 3) onto the X and Y strips 18 and 19. The X control switches are indicated at 32 and the Y control switches are indicated at 33. Only the overlap (points 28 and 29) of the two strips will have a bias voltage -HV sufficient to create an electron avalanche 27 in the vicinity of the pixel (phosphor 17) to be illuminated. The schematic of FIG. 5 can be expanded to any X and Y strip multiplicity envisioned for video display applications, e.g., 640×480 X/Y pixels.

FIG. 6 illustrates in detail one of the eight (8) X or Y control logic-level driven HV switches. It is understood that the number of X and Y control switches is determined by the number of pixels in the microgap flat panel display.

It has thus been shown that the microgap flat panel display of this invention can be fabricated using standard photolithographic and deposition techniques, enables applications such as curved or spherical displays, and is not affected by magnetic fields. In addition, the extreme speed of the electron avalanche allows video rates that are much greater than standard video. The small size of the electron avalanche and the proximity focusing eliminates complicated electron optics, raster systems, filters and guns, and allows pixel densities much greater than currently available. Also, due to the low mass and low power consumption, the microgap flat panel display can be utilized for avionic and other systems where weight and power consumption are considerations.

While particular embodiments. materials, parameters, voltages, etc. have been illustrated and/or described, to exemplify and explain the principles of the invention, such are not intended to be limiting. Modifications and changes may become apparent to those skilled in the art, and it is intended that the invention be limited only be the scope of the appended claims.

The invention claimed is:

1. A panel display, including:

an anode having an array of luminescent phosphors spaced thereon;

a cathode structure having X and Y oriented electrically conductive strips;

said anode and cathode structure being separated by a gas-filled region;

means for applying a voltage across the gas-filled region; and means connected to said cathode structure for initiating an electron avalanche from said cathode structure to said anode for activating a phosphor on said anode.

2. The panel display of claim 1, wherein said anode and said cathode structure are co-planar.

3. The panel display of claim 1, wherein said means for applying a voltage include means for applying a bias voltage across overlapping points on said X and Y conductive strips.

4. The panel display of claim 1, wherein said array of spaced phosphors are selected from the group of monochrome and color additive phosphors.

5. The panel display of claim 4, wherein said phosphors comprises an array of sets of three color additive phosphors.

6. The panel display of claim 5, wherein said X and Y conductive strips are positioned in spaced relation to correspond to the sets of three color additive phosphors.

7. The panel display of claim 1, wherein said means for initiating an electron avalanche includes a quantity of a long-lived radioactive material.

8. The panel display of claim 1, wherein said radioactive material in americium-241.

9. The panel display of claim 1, wherein said means for initiating an electron avalanche includes an array of atomically sharp points.

10. The panel display of claim 9, wherein said atomically sharp points are located to correspond to a location of the spaced phosphors.

11. The panel display of claim 10, wherein said atomically sharp points are composed of material selected from the group of silicon, GaAs, $SiO_2$, and $Si_3N_4$.

12. The panel display of claim 1, wherein said gas-filled region contains a gas selected from the group consisting of argon, argon/isobutane, and $Ar/CH_4$.

13. A microgap flat panel display, comprising:

co-planar anode and cathode structure;

said co-planar anode and cathode structure being separated by a gas-filled gap;

said anode including an array of luminescent phosphors;

said cathode structure including a plurality of electrically conductive strips position in X and Y orientations, said X oriented strips being insulated from said Y oriented strips;

said cathode structure including means for initiating an electron avalanche selected from the group consisting of a radioisotope and atomically sharp points; and means for applying a voltage across the gas-filled gap and applying a bias voltage across the conductive strips.

14. The microgap flat panel display of claim 13, wherein said gas-filled gap between said anode and said cathode structure is about 100 micron, wherein said voltage applied across the gas-filled gap is about 500 volts, and wherein said array of luminescent phosphors are selected from the group of monochrome and color additive phosphors.

15. The microgap flat panel display of claim 13, wherein said luminescent phosphors are located on said anode to correspond to overlap regions of said X and Y conductive strips of said cathode structure, whereby application of a bias voltage across an overlap region of the X and Y conductive strips initiates an electron avalanche which activates a corresponding luminescent phosphor.

16. The microgap flat panel display of claim 13, additionally including a switching system for applying a bias voltage across one or more overlap regions of said X and Y oriented conductive strips, whereby one or more of the array of luminescent phosphors can be activated either singly, in sequence or simultaneously.

17. The microgap flat panel display of claim 13, wherein gas-filled region contains gas selected from the group of argon, argon/isobutane, and $Ar/CH_4$.

18. The microgap flat panel display of claim 13, wherein said radioisotope is selected from the group of americium-241, Th-228, and Cm-244.

19. The microgap flat panel display of claim 13, wherein said coplanar anode and cathode structure can be positioned in flat, curved, or spherical orientations.

* * * * *